US012344910B2

(12) United States Patent
Yoshimura et al.

(10) Patent No.: US 12,344,910 B2
(45) Date of Patent: Jul. 1, 2025

(54) DUPLEX STAINLESS STEEL, SEAMLESS STEEL PIPE OR TUBE, AND A METHOD OF MANUFACTURING THE DUPLEX STAINLESS STEEL

(71) Applicant: JFE STEEL CORPORATION, Tokyo (JP)

(72) Inventors: Yusuke Yoshimura, Tokyo (JP); Shunsuke Sasaki, Tokyo (JP); Yuichi Kamo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 881 days.

(21) Appl. No.: 17/426,245

(22) PCT Filed: Nov. 14, 2019

(86) PCT No.: PCT/JP2019/044765
§ 371 (c)(1),
(2) Date: Jul. 28, 2021

(87) PCT Pub. No.: WO2020/158111
PCT Pub. Date: Aug. 6, 2020

(65) Prior Publication Data

US 2022/0106659 A1 Apr. 7, 2022

(30) Foreign Application Priority Data

Jan. 30, 2019 (JP) ..... JP2019-014033

(51) Int. Cl.

| | |
|---|---|
| ***C21D 9/08*** | (2006.01) |
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C21D 9/08* (2013.01); *C21D 6/004* (2013.01); *C21D 6/005* (2013.01); *C21D 6/008* (2013.01); *C21D 8/105* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01)

(58) Field of Classification Search
None
See application file for complete search history.

(56) References Cited

U.S. PATENT DOCUMENTS

| | | | | |
|---|---|---|---|---|
| 4,055,448 | A | 10/1977 | Fujikura et al. | |
| 4,353,755 | A | 10/1982 | Solomon | |
| 5,238,508 | A | 8/1993 | Yoshitake et al. | |
| 6,451,133 | B1 * | 9/2002 | Frodigh | C22C 38/58 148/327 |
| 8,293,037 | B2 | 10/2012 | Suwabe et al. | |
| 11,066,719 | B2 | 7/2021 | Motoya et al. | |
| 2008/0175742 | A1 | 7/2008 | Suzuki | |
| 2011/0024005 | A1 | 2/2011 | Suwabe | |
| 2011/0290377 | A1 | 12/2011 | Suwabe et al. | |
| 2013/0312880 | A1 | 11/2013 | Motoya et al. | |
| 2013/0315776 | A1 | 11/2013 | Yamada et al. | |
| 2019/0211416 | A1 | 7/2019 | Yoshimura et al. | |
| 2019/0352752 | A1 | 11/2019 | Eguchi et al. | |

FOREIGN PATENT DOCUMENTS

| | | | | |
|---|---|---|---|---|
| CN | 103320707 | A | * | 9/2013 |
| EP | 0566814 | A1 | | 10/1993 |
| JP | S50105504 | A | | 8/1975 |
| JP | S60165363 | A | | 8/1985 |
| JP | 61023713 | A | * | 2/1986 |
| JP | H06271939 | A | | 9/1994 |
| JP | H09241746 | A | | 9/1997 |
| JP | 2008179844 | A | | 8/2008 |
| JP | 2016183404 | A | | 10/2016 |
| WO | 2010082395 | A1 | | 7/2010 |

(Continued)

OTHER PUBLICATIONS

English language machine translation of CN-103320707-A. Generated Jun. 29, 2024. (Year: 2024).*
English language machine translation of JP-61023713-A. Generated Jun. 29, 2024. (Year: 2024).*
Feb. 10, 2022, the Extended European Search Report issued by the European Patent Office in the corresponding European Patent Application No. 19913020.4.
Feb. 10, 2020, International Search Report issued in the International Patent Application No. PCT/JP2019/044765.

*Primary Examiner* — Brian D Walck
(74) *Attorney, Agent, or Firm* — KENJA IP LAW PC

(57) ABSTRACT

Provided is duplex stainless steel which has high strength and high toughness and can be subjected to hot working during manufacturing processes, the duplex stainless steel having a predetermined chemical composition and a microstructure containing an austenite phase in a volume fraction of 20% to 70% and a ferrite phase in a volume fraction of 30% to 80%, and mechanical properties such that a yield strength is 862 MPa or more and an absorption energy in a Charpy impact test at −10° C., $vE_{-10}$, is 40 J or more.

7 Claims, No Drawings

(56) References Cited

FOREIGN PATENT DOCUMENTS

| | | | |
|---|---|---|---|
| WO | 2017208946 | A1 | 12/2017 |
| WO | 2018043214 | A1 | 3/2018 |
| WO | 2018131412 | A1 | 7/2018 |

* cited by examiner

DUPLEX STAINLESS STEEL, SEAMLESS STEEL PIPE OR TUBE, AND A METHOD OF MANUFACTURING THE DUPLEX STAINLESS STEEL

TECHNICAL FIELD

This disclosure relates to duplex stainless steel, in particular, duplex (dual-phase) stainless steel which has excellent strength and toughness and can be subjected to hot working during manufacturing processes. Further, this disclosure relates to a seamless steel pipe or tube and a method of manufacturing the duplex stainless steel.

BACKGROUND

From the perspective of the steep rise of crude oil prices and depletion of oil resources expected in the near future, oil fields having a deep depth which have not been paid attention and oil and gas fields located in severe corrosive environments under so-called sour environments containing hydrogen sulfide and the like have been recently developed actively. Those oil and gas fields have commonly an extremely deep depth and high temperature atmosphere and are located in a severe corrosive environment containing carbon dioxide ($CO_2$), chlorine ion ($Cl^-$), and hydrogen sulfide ($H_2S$). Therefore, for steel pipes or tubes for oil wells used under such an environment, a material having high strength and toughness and excellent corrosion resistance (carbon dioxide corrosion resistance, sulfide stress corrosion cracking resistance, and sulfide stress cracking resistance) are required to be used.

Accordingly, in oil and gas fields located in an environment containing much $CO_2$, $Cl^+$, and the like, duplex stainless steel materials, which have excellent corrosion resistance, are used as materials of oil country tubular goods. Further, various techniques are proposed to increase the strength of duplex stainless steel.

For example, JPH09-241746A (PTL 1) proposes a method of manufacturing a duplex stainless steel pipe or tube having high strength comprising: reheating a duplex stainless steel pipe or tube subjected to final rolling to a temperature T (° C.) satisfying 800+5 Cr (%)+25 Mo (%)+15 W (%)≤T≤1150 and subsequently rapidly cooling the pipe or tube.

Further, JPH06-271939A (PTL 2) proposes a method of manufacturing a high-strength duplex stainless steel material, using austenitic-ferritic duplex stainless steel containing Cu. In the manufacturing method, a high-strength duplex stainless steel material is manufactured by first, heating duplex stainless steel to 1000° C. or higher and subjecting it to hot working, subsequently rapidly cooling it from a temperature of 800° C. or higher, then subjecting it to warm working at 300° C. to 700° C. and further to cold working. PTL 2 also discloses that after the cold working, the duplex stainless steel is subjected to aging heat treatment at 450° C. to 700° C.

WO2010/082395A1 (PTL 3) proposes a method of manufacturing a duplex stainless steel pipe or tube having a minimum yield strength of 758.3 MPa to 965.2 MPa. In the manufacturing method, when a duplex stainless steel material having a predetermined chemical composition is subjected to hot working to obtain an open pipe or tube that is a cylindrical strip before welding for cold working, and the open pipe or tube for cold working is cold rolled to manufacture a steel pipe or tube, the amount of deformation Rd represented by a reduction in area during the final cold rolling process is controlled within a specific range.

JP2008-179844A (PTL 4) proposes duplex stainless steel containing C, Si, Mn, Ni, Cr, Cu, and N and having a ferrite phase with an area ratio of 20% to 60%.

CITATION LIST

Patent Literatures

PTL 1: JPH09-241746A
PTL 2: JPH06-271939A
PTL 3: WO2010/082395A1
PTL 4: JP2008-179844A

SUMMARY

Technical Problem

However, the yield strength of a duplex stainless steel pipe or tube obtained by the manufacturing method proposed in PTL 1 is only about 680 MPa and the range of utilizing the duplex stainless steel pipe or tube for oil country tubular goods is limited.

Further, in the techniques to increase the strength proposed in PTL 2 and PTL 3, the cold working ratio needs to be increased to improve the strength, and thus, it takes long hours to manufacture.

The duplex stainless steel proposed in PTL 4 has excellent corrosion resistance and high strength, but the duplex stainless steel contains so excessive alloy components that it has poor hot workability.

It would thus be helpful to provide duplex stainless steel having high strength and toughness and excellent hot workability which is suitable as a material of oil country tubular goods of crude oil or oil country tubular goods of natural gas.

As used herein, the "high strength" refers to a yield strength (YS) of 862 MPa or more. Further, the "high toughness" refers to absorption energy in a Charpy impact test at −10° C., $vE_{-10}$, of 40 J or more.

Solution to Problem

For solving the problems stated above, the inventors conducted a study about the strength and toughness of duplex stainless steel and found the following.

Duplex stainless steel having excellent corrosion resistance in a corrosive atmosphere containing $CO_2$, $Cl^-$, and $H_2S$, and under an environment in which a stress close to the yield strength is applied can be obtained by making the microstructure of the steel a complex structure containing an austenite phase as a primary phase at 20% to 70% and a ferrite phase as a secondary phase.

In such duplex stainless steel, a high strength of YS: 862 MPa or more can be achieved by adjusting the steel composition to contain at least a certain amount of Cu and subjecting the steel to slight cold working. Further, excellent toughness can be achieved by lowering N to less than 0.075% to suppress the formation of nitride during aging heat treatment.

This disclosure is based on the above findings and has the following primary features.

1. Duplex stainless steel comprising:

a chemical composition containing (consisting of), in mass %,

C: 0.03% or less,

Si: 1.0% or less,

Mn: 0.10% to 1.5%,

P: 0.030% or less,

S: 0.005% or less,

Cr: 20.0% to 30.0%,

Ni: 5.0% to 10.0%,

Mo: 2.0% to 5.0%,

Cu: 1.0% or more and less than 2.0%, and

N: less than 0.075%, with a balance being Fe and inevitable impurities, a microstructure containing:

an austenite phase in a volume fraction of 20% to 70%; and a ferrite phase in a volume fraction of 30% to 80%; and mechanical properties such that a yield strength YS is 862 MPa or more and an absorption energy in a Charpy impact test at −10° C., $vE_{-10}$, is 40 J or more.

2. The duplex stainless steel according to 1., wherein the chemical composition further contains, in mass %, W: 1.5% or less.

3. The duplex stainless steel according to 1. or 2., wherein the chemical composition further contains, in mass %, V: 0.20% or less.

4. The duplex stainless steel according to any one of 1. to 3., wherein the chemical composition further contains, in mass %, at least one of Zr: 0.50% or less and B: 0.0030% or less.

5. The duplex stainless steel according to any one of 1. to 4., wherein the chemical composition further contains, in mass %, at least one selected from the group consisting of REM: 0.005% or less, Ca: 0.005% or less, Sn: 0.20% or less, and Mg: 0.01% or less.

6. The duplex stainless steel according to any one of 1. to 5., wherein the chemical composition further contains, in mass %, at least one selected from the group consisting of Ta: 0.1% or less, Co: 1.0% or less, and Sb: 1.0% or less.

7. The duplex stainless steel according to any one of 1. to 6., wherein the chemical composition further contains, in mass %, at least one selected from the group consisting of Al: 0.5% or less, Ti: 0.5% or less, and Nb: 0.5% or less.

8. A seamless steel pipe or tube made of the duplex stainless steel according to any one of 1. to 7.

9. A method of manufacturing the duplex stainless steel according to any one of 1. to 7., the method comprising:

subjecting a steel raw material having the chemical composition according to any one of claims 1 to 7 to solution treatment whereby the steel raw material is heated to a heating temperature of 1000° C. or higher; then, cooled at an average cooling rate of 1° C./s or more to a cooling stop temperature of 300° C. or lower, subjecting the steel raw material after the solution treatment to cold working with a rolling reduction in a thickness direction of 5% to 10%, and subjecting the steel raw material after the cold working to aging heat treatment whereby the steel raw material is heated to a heating temperature of 350° C. to 600° C., held at the heating temperature for a holding time of 5 minutes or more and 100 minutes or less, and subsequently cooled.

Advantageous Effect

According to this disclosure, it is possible to obtain duplex stainless steel which has excellent strength and toughness and can be subjected to hot working during manufacturing processes.

DETAILED DESCRIPTION

Next, a detailed description is given below. The following provides a description of preferred embodiments and the present disclosure is by no means limited to the description.

[Chemical Composition]

The chemical composition of the duplex stainless steel according to the disclosure and the reasons for limiting it are described next. Mass percentage (mass %) will be simply noted as % hereinafter, unless otherwise specified herein.

C: 0.03% or Less

C is an element effective for stabilizing an austenite phase to improve the strength and low-temperature toughness. However, when the C content is more than 0.03%, the precipitation of carbides caused by heat treatment becomes excessive, and the excessive entry of diffusible hydrogen into the steel cannot be prevented. As a result, the corrosion resistance of the steel is deteriorated. Therefore, the C content is set to 0.03% or less, preferably 0.02% or less, and more preferably 0.01% or less. No lower limit is placed on the C content, yet from the viewpoint of improving the effect of adding C, it is preferable to set the C content to 0.004% or more.

Si: 1.0% or Less

Si is an effective element as a deoxidizer. However, when the Si content is more than 1.0%, the precipitation of intermetallic compounds caused by heat treatment becomes excessive, deteriorating the corrosion resistance of the steel. Accordingly, the Si content is set to 1.0% or less, preferably 0.7% or less, and more preferably 0.6% or less. On the other hand, no lower limit is placed on the Si content, yet to sufficiently obtain the effect, the Si content is preferably set to 0.05% or more and more preferably 0.10% or more.

Mn: 0.10% to 1.5%

Mn is an effective element as a deoxidizer as with Si and stabilizes S inevitably contained in the steel as sulfide to improve the hot workability. These effects are obtained when the Mn content is 0.10% or more.

Therefore, the Mn content is set to 0.10% or more, preferably 0.15% or more, and more preferably 0.20% or more. On the other hand, the Mn content exceeding 1.5% not only lowers the hot workability but also adversely affects the corrosion resistance. Accordingly, the Mn content is set to 1.5% or less, preferably 1.0% or less, and more preferably 0.50% or less.

P: 0.030% or Less

P lowers the corrosion resistance such as carbon dioxide corrosion resistance, pitting corrosion resistance, and sulfide stress cracking resistance, and thus it is preferable to reduce P as much as possible, yet 0.030% or less is allowable. Accordingly, the P content is set to 0.030% or less, preferably 0.020% or less, and more preferably 0.015% or less. On the other hand, no lower limit is placed on the P content. Excessively reducing P, however, involves high refining cost and is economically disadvantageous. Therefore, the P content is preferably set to 0.005% or more, and more preferably 0.007% or more.

S: 0.005% or Less

S is an element of significantly lowering the hot workability to inhibit the stable operation in steel pipe or tube manufacturing processes, and thus, it is preferable to reduce S as much as possible. However, if the S content is 0.005% or less, a steel pipe or tube can be manufactured in usual processes. Therefore, the S content is set to 0.005% or less, preferably 0.002% or less, and more preferably 0.0015% or less. On the other hand, no lower limit is placed on the S content, yet excessively reducing S is industrially difficult and thus increases desulfurization costs in steelmaking processes and lowers the productivity. Therefore, the S content is preferably 0.0001% or more, and more preferably 0.0005% or more.

Cr: 20.0% to 30.0%

Cr is a basic component effective for maintaining the corrosion resistance and improve the strength. To obtain these effects, the Cr content needs to be 20.0% or more. Accordingly, the Cr content is set to 20.0% or more. To obtain a higher strength, the Cr content is preferably set to 21.0% or more, and more preferably 21.5% or more. On the other hand, when the Cr content is more than 30.0%, a σ phase which is a phase of an intermetallic compound of Fe and Cr tends to be precipitated, deteriorating the corrosion resistance and toughness. Accordingly, the Cr content is set to 30.0% or less. From the viewpoint of further improving the sulfide stress cracking resistance and toughness, the Cr content is preferably set to 28.0% or less, and more preferably 26.0% or less.

Ni: 5.0% to 10.0%

Ni is an element contained to stabilize an austenite phase and obtain a duplex microstructure. When the Ni content is less than 5.0%, a microstructure mainly composed of a ferrite phase is generated and a duplex microstructure cannot be obtained. Accordingly, the Ni content is set to 5.0% or more, and preferably 6.0% or more. On the other hand, when the Ni content is more than 10.0%, a microstructure mainly composed of austenite is generated and a duplex microstructure cannot be obtained. Further, Ni is an expensive element and thus an excessive Ni content lowers the economic efficiency. Accordingly, the Ni content is set to 10.0% or less, and preferably 8.5% or less.

Mo: 2.0% to 5.0%

Mo is an element that increases the resistance to pitting corrosion caused by and a low pH to improve the sulfide stress cracking resistance and sulfide stress corrosion cracking resistance. To obtain this effect, the Mo content needs to be 2.0% or more. Accordingly, the Mo content is set to 2.0% or more, and preferably 2.5% or more. On the other hand, when the Mo content exceeds 5.0%, a α phase is precipitated to lower the toughness and corrosion resistance. Accordingly, the Mo content is set to 5.0% or less, preferably 4.5% or less, and more preferably 3.5% or less.

Cu: 1.0% or More and Less than 2.0%

Cu is an element having an action of precipitating fine ε-Cu during aging heat treatment to significantly improve the strength. Further, Cu has an action of forming a firm protective coating on a surface of the stainless steel to inhibit hydrogen entry into the steel and improve the sulfide stress cracking resistance and sulfide stress corrosion cracking resistance. Therefore, in this disclosure, it is significantly important to contain a suitable amount of Cu. To obtain the effect stated above, the Cu content needs to be 1.0% or more. Accordingly, the Cu content is set to 1.0% or more, preferably 1.1% or more, more preferably 1.2% or more, and further preferably 1.3% or more. On the other hand, when the Cu content is 2.0% or more, ε-Cu is excessively precipitated to lower the low-temperature toughness and additionally, reduce the sulfide stress corrosion cracking resistance and sulfide stress cracking resistance. Further, when the Cu content is 2.0% or more, the hot workability is deteriorated by hot working cracking, making the pipe or tube formation impossible. Accordingly, the Cu content is set to less than 2.0%, and preferably 1.9% or less.

N: Less than 0.075%

N is known as an element which improves the pitting corrosion resistance and contributes to solid solution strengthening in usual duplex stainless steel. N is actively added in an amount of 0.10% or more. However, the inventors newly found that (1) when an aging heat treatment is performed, N forms various nitrides and lowers the sulfide stress corrosion cracking resistance and sulfide stress cracking resistance at a low temperature of 80° C. or lower and (2) the aforementioned action is significant when the N content is 0.075% or more. Accordingly, the N content is set to less than 0.075%, preferably 0.05% or less, more preferably 0.03% or less, and further preferably 0.015% or less. On the other hand, no lower limit is placed on the N content, but to obtain more excellent properties, the N content is preferably set to 0.001% or more and more preferably 0.005% or more.

A duplex stainless steel according to one of the disclosed embodiments may have a chemical composition containing the elements stated above with the balance being Fe and inevitable impurities. The basic components in this disclosure are as stated above. The objective properties of this disclosure can be obtained using the basic components, but the optional elements stated below may be further contained. The content of 0 contained as an inevitable impurity is preferably set to 0.01% or less.

The chemical composition of duplex stainless steel according to another embodiment can further optionally contain W in an amount stated below.

W: 1.5% or Less

W is an element effective for further improving the sulfide stress corrosion cracking resistance and sulfide stress cracking resistance. However, when the W content is more than 1.5%, at least one of the toughness and the sulfide stress cracking resistance may be lowered. Accordingly, when W is added, the W content is set to 1.5% or less, preferably 1.2% or less, and more preferably 1.0% or less. On the other hand, no lower limit is placed on the W content, but from the viewpoint of improving the effect of adding W, the W content is preferably set to 0.02% or more, more preferably 0.3% or more, and further preferably 0.4% or more.

The chemical composition of duplex stainless steel according to another embodiment can further optionally contain V in an amount stated below.

V: 0.20% or Less

V is an element which further improves the strength of the steel by precipitation strengthening. However, when the V content is more than 0.20%, at least one of the toughness and the sulfide stress cracking resistance may be lowered. Accordingly, when V is added, the V content is set to 0.20% or less, preferably 0.08% or less, and more preferably 0.07% or less. On the other hand, no lower limit is placed on the V content, but from the viewpoint of improving the effect of adding V, the V content is preferably set to 0.02% or more, more preferably 0.03% or more, and further preferably 0.04% or more.

The chemical composition of duplex stainless steel according to another embodiment can further optionally contain at least one of Zr and B in an amount stated below.

Zr and B are effective as an element which further improves the strength, and may be selectively contained as necessary.

Zr: 0.50% or Less

Zr contributes to increase in the strength as stated above and to further improvement in the sulfide stress corrosion cracking resistance. However, when the Zr content is more than 0.50%, at least one of the toughness and the sulfide stress cracking resistance may be lowered. Accordingly, when Zr is contained, the Zr content is set to 0.50% or less, preferably 0.40% or less, and more preferably 0.30% or less. On the other hand, no lower limit is placed on the Zr content, but from the viewpoint of improving the effect of adding Zr, the Zr content is preferably set to 0.02% or more, more preferably 0.05% or more, and further preferably 0.10% or more.

B: 0.0030% or Less

B is effective as an element which contributes to increase in the strength as stated above and to further improvement in the hot workability. However, when the B content is more than 0.0030%, the toughness and hot workability may be lowered. Further, when a large amount of B is contained, the sulfide stress cracking resistance may be lowered. Accordingly, when B is contained, the B content is set to 0.0030% or less, preferably 0.0028% or less, and more preferably 0.0027% or less. On the other hand, no lower limit is placed on the B content, yet from the viewpoint of improving the effect of adding B, the B content is preferably set to 0.0005% or more, more preferably 0.0008% or more, and further preferably 0.0010% or more.

The chemical composition of duplex stainless steel according to another embodiment can further optionally contain at least one selected from the group consisting of REM, Ca, Sn, and Mg in an amount stated below. REM, Ca, Sn, and Mg are elements which contribute to further improvement in the sulfide stress corrosion cracking resistance, and may be selectively contained as necessary.

REM: 0.005% or Less

REM (rare-earth metal) is an element which improves the sulfide stress corrosion cracking resistance as stated above. However, a REM content exceeding 0.005% is economically disadvantageous because the effect of adding REM saturates to fail to offer an effect commensurate with the content. Therefore, when REM is added, the REM content is set to 0.005% or less and preferably 0.004% or less. On the other hand, no lower limit is placed on the REM content, yet from the viewpoint of increasing the effect of adding REM, the REM content is preferably set to 0.001% or more and more preferably 0.0015% or more.

Ca: 0.005% or Less

Ca is an element which contribute to improvement in the sulfide stress corrosion cracking resistance as stated above. However, a Ca content exceeding 0.005% is economically disadvantageous because the effect of adding Ca saturates to fail to offer an effect commensurate with the content. Therefore, when Ca is added, the Ca content is set to 0.005% or less and preferably 0.004% or less. On the other hand, no lower limit is placed on the Ca content, yet from the viewpoint of increasing the effect of adding Ca, the Ca content is preferably set to 0.001% or more and more preferably 0.0015% or more.

Sn: 0.20% or Less

Sn is an element which improves the sulfide stress corrosion cracking resistance as stated above. However, a Sn content exceeding 0.20% is economically disadvantageous because the effect of adding Sn saturates to fail to offer an effect commensurate with the content. Therefore, when Sn is added, the Sn content is set to 0.20% or less and preferably 0.15% or less. On the other hand, no lower limit is placed on the Sn content, yet from the viewpoint of increasing the effect of adding Sn, the Sn content is preferably set to 0.05% or more and more preferably 0.09% or more.

Mg: 0.01% or Less

Mg is an element which improves the sulfide stress corrosion cracking resistance as stated above. However, a Mg content exceeding 0.01% is economically disadvantageous because the effect of adding Mg saturates to fail to offer an effect commensurate with the content. Therefore, when Mg is added, the Mg content is set to 0.01% or less and preferably 0.005% or less. On the other hand, no lower limit is placed on the Mg content, yet from the viewpoint of increasing the effect of adding Mg, the Mg content is preferably set to 0.0002% or more and more preferably 0.0005% or more.

The chemical composition of duplex stainless steel according to another embodiment can further optionally contain at least one selected from the group consisting of Ta, Co, and Sb in an amount stated below. Ta, Co, and Sb are elements which further improve the $CO_2$ corrosion resistance, sulfide stress cracking resistance, and sulfide stress corrosion cracking resistance, and may be selectively contained as necessary.

Ta: 0.1% or Less

No lower limit is placed on the Ta content, yet from the viewpoint of increasing the effect of adding Ta, the Ta content is preferably set to 0.01% or more and more preferably 0.03% or more. On the other hand, a Ta content exceeding 0.1% is economically disadvantageous because the effect of adding Ta saturates to fail to offer an effect commensurate with the content. Therefore, when Ta is added, the Ta content is set to 0.1% or less and preferably 0.07% or less.

Co: 1.0% or Less

Co has the effect stated above and additionally increases the Ms point to further improve the strength. No lower limit is placed on the Co content, yet from the viewpoint of increasing the effect of adding Co, the Co content is preferably set to 0.01% or more and more preferably 0.03% or more. On the other hand, a Co content exceeding 1.0% is economically disadvantageous because the effect of adding Co saturates to fail to offer an effect commensurate with the content. Therefore, when Co is added, the Co content is set to 1.0% or less and preferably 0.3% or less.

Sb: 1.0% or Less

No lower limit is placed on the Sb content, yet for the viewpoint of increasing the effect of adding Sb, the Sb content is preferably set to 0.01% or more and more preferably 0.03% or more. On the other hand, a Sb content exceeding 1.0% is economically disadvantageous because the effect of adding Sb saturates to fail to offer an effect commensurate with the content. Therefore, when Sb is added, the Sb content is set to 1.0% or less and preferably 0.3% or less.

The chemical composition of duplex stainless steel according to another embodiment can further optionally contain at least one selected from the group consisting of Al, Ti, and Nb in an amount stated below. Al, Ti, and Nb are elements which form intermetallic compounds with Ni during aging heat treatment and significantly improve the strength without lowering the sulfide stress corrosion cracking resistance and sulfide stress cracking resistance at a low temperature of 80° C. or lower.

Al: 0.5% or Less

No lower limit is placed on the Al content, yet for the viewpoint of increasing the effect of adding Al, the Al content is preferably set to 0.05% or more and more preferably 0.30% or more. On the other hand, when the Al content exceeds 0.5%, intermetallic compounds are excessively precipitated to lower the sulfide stress corrosion cracking resistance and sulfide stress cracking resistance at a low temperature. Therefore, when Al is added, the Al content is set to 0.5% or less.

Ti: 0.5% or Less

No lower limit is placed on the Ti content, yet for the viewpoint of increasing the effect of adding Ti, the Ti content is preferably set to 0.02% or more and more preferably 0.30% or more. On the other hand, when the Ti content exceeds 0.5%, intermetallic compounds are excessively precipitated to lower the sulfide stress corrosion cracking resistance and sulfide stress cracking resistance at a low temperature. Therefore, when Ti is added, the Ti content is set to 0.5% or less.

Nb: 0.5% or Less

No lower limit is placed on the Nb content, yet for the viewpoint of increasing the effect of adding Nb, the Nb content is preferably set to 0.02% or more and more preferably 0.30% or more. On the other hand, when the Nb content exceeds 0.5%, intermetallic compounds are excessively precipitated to lower the sulfide stress corrosion cracking resistance and sulfide stress cracking resistance at a low temperature. Therefore, when Nb is added, the Nb content is set to 0.5% or less.

Duplex stainless steel according to another embodiment can have a chemical composition containing, in mass %, C: 0.03% or less,
Si: 1.0% or less,
Mn: 0.10% to 1.5%,
P: 0.030% or less,
S: 0.005% or less,
Cr: 20.0% to 30.0%,
Ni: 5.0% to 10.0%,
Mo: 2.0% to 5.0%,
Cu: 1.0% or more and less than 2.0%,
N: less than 0.075%,
optionally, W: 1.5% or less,
optionally, V: 0.20% or less,
optionally, at least one of Zr: 0.50% or less and B: 0.0030% or less,
optionally, at least one selected from the group consisting of REM: 0.005% or less, Ca: 0.005% or less, Sn: 0.20% or less, and Mg: 0.01% or less,
optionally, at least one selected from the group consisting of Ta: 0.1% or less, Co: 1.0% or less, and Sb: 1.0% or less,
optionally, at least one selected from the group consisting of Al: 0.5% or less, Ti: 0.5% or less, and Nb: 0.5% or less,
with the balance being Fe and incidental impurities.

[Microstructure]

The microstructure of duplex stainless steel according to this disclosure and the reasons for limiting it are described next. In the following description, the ratio of each phase is represented by a volume fraction with respect to a whole volume of the steel material microstructure.

Duplex stainless steel of this disclosure has a microstructure containing an austenite phase in a volume fraction of 20% to 70% and a ferrite phase in a volume fraction of 30% to 80%.

Austenite Phase: 20% to 70%

When the volume fraction of an austenite phase is less than 20%, a desired low-temperature toughness value cannot be obtained. Therefore, the volume fraction of an austenite phase with respect to a whole volume of the microstructure is set to 20% or more, preferably 30% or more, and more preferably 40% or more. On the other hand, when the volume fraction of an austenite phase exceeds 70%, a desired high strength cannot be obtained. Accordingly, the volume fraction of an austenite phase is set to 70% or less, preferably 65% or less, and more preferably 60% or less.

Ferrite Phase: 30% to 80%

When the volume fraction of a ferrite phase is less than 30%, a desired high strength cannot be obtained. Therefore, the volume fraction of a ferrite phase is set to 30% or more, preferably 35% or more, and more preferably 40% or more. On the other hand, when the volume fraction of a ferrite phase exceeds 80%, a desired low-temperature toughness value cannot be obtained. Accordingly, the volume fraction of a ferrite phase is set to 80% or less, preferably 70% or less, and more preferably 60% or less.

The microstructure of duplex stainless steel according to one embodiment may only consist of an austenite phase and a ferrite phase. In other words, duplex stainless steel according to one embodiment can have a microstructure consisting of 20% to 70% of an austenite phase and 30% to 80% of a ferrite phase. Alternatively, the microstructure of duplex stainless steel according to another embodiment may contain precipitates as the balance other than the austenite phase and the ferrite phase. As the precipitates, for example, at least one selected from the group consisting of intermetallic compounds, carbides, nitrides, and sulfides can be contained. The content of the precipitates is not particularly limited, but the total volume fraction of the precipitates is preferably 1% or less. That is, duplex stainless steel according to one embodiment can have a microstructure containing 20% to 69% of an austenite phase, 30% to 79% of a ferrite phase, and 1% or less of precipitates.

[Mechanical Properties]

Yield Strength: 862 MPa or More

Duplex stainless steel of this disclosure has a yield strength (YS) of 862 MPa or more. The yield strength is preferably 870 MPa or more and more preferably 880 MPa or more. On the other hand, no upper limit is placed on the yield strength. For example, the yield strength may be 1034 MPa or less, 1020 MPa or less, or 1010 MPa or less.

$vE_{-10}$: 40 J or More

Duplex stainless steel of this disclosure has an absorption energy in a Charpy impact test at −10° C., $vE_{-10}$, of 40 J or more. $vE_{-10}$ is preferably 43 J or more and more preferably 49 J or more. On the other hand, no upper limit is placed on $vE_{-10}$. For example, $vE_{-10}$ may be 70 J or less, 65 J or less, or 60 J or less.

Tensile Strength

The tensile strength of duplex stainless steel of this disclosure is not particularly limited and may be any value, yet the tensile strength is preferably 900 MPa or more, more preferably 910 MPa or more, and further preferably 920 MPa or more. No upper limit is placed on the tensile strength. For example, the tensile strength may be 1060 MPa or less, 1050 MPa or less, or 1040 MPa or less.

[Manufacturing Method]

A method of manufacturing duplex stainless steel of this disclosure will now be described below. The temperature in the following description refers to a surface temperature of a material to be treated (such as a steel raw material).

The duplex stainless steel can be manufactured by subjecting a steel raw material having the chemical composition stated above to a solution treatment, to cold working after the solution treatment, and to an aging treatment after the cold working.

As a starting material to be subjected to the solution treatment, a steel raw material (stainless steel) having the chemical composition stated above is used. The manufacturing method of the steel raw material is not particularly limited and can be manufactured by any method.

(Solution Treatment)

First, the steel raw material is subjected to a solution treatment. In the solution treatment, the steel raw material is heated to a heating temperature of 1000° C. or higher, and then cooled to a cooling stop temperature of 300° C. or lower at an average cooling rate of 1° C./s or more. This can produce duplex stainless steel having a microstructure in which intermetallic compounds, carbides, nitrides, sulfides, and the like having precipitated during the manufacturing process of the steel raw material are dissolved and in which an austenite phase and a ferrite phase are contained at a desired volume fraction.

Heating Temperature: 1000° C. or Higher

When the heating temperature in the solution heat treatment is lower than 1000° C., a desired high toughness cannot be obtained. Accordingly, the heating temperature is set to 1000° C. or higher, and preferably 1050° C. or higher. On the other hand, no upper limit is placed on the heating temperature, yet from the viewpoint of preventing the coarsening of the microstructure, the heating temperature is preferably set to 1150° C. or lower and more preferably 1100° C. or lower. As used herein, the heating temperature is the temperature of the steel raw material surface.

The holding time during the solution heat treatment is not particularly limited. However, from the viewpoint of making the temperature in the steel raw material uniform, the holding time at the heating temperature is preferably set to 5 minutes or more, more preferably 10 minutes or more, and further preferably 20 minutes or more. No upper limit is placed on the holding time, but the holding time at the heating temperature is preferably set to 210 minutes or less.

Average Cooling Rate: 1° C./s or More

When the average cooling rate in the cooling process of the solution heat treatment is less than 1° C./s, intermetallic compounds such as the a phase and the $\chi$ phase are precipitated during the cooling to significantly lower the low-temperature toughness and corrosion resistance. Accordingly, the average cooling rate is set to 1° C./s or more. The average cooling rate is preferably 10° C./s or more, and more preferably 20° C./s. On the other hand, no upper limit is placed on the average cooling rate, but the average cooling rate may be, for example, 30° C./s or less. As used herein, the average cooling rate is an average of the cooling rate in the range from the heating temperature to the cooling stop temperature. Any cooling method can be used in the solution heat treatment, but water cooling is preferable.

Cooling Stop Temperature: 300° C. or Lower

When the cooling stop temperature in the cooling process of the solution heat treatment is higher than 300° C., the a prime phase is precipitated thereafter to significantly lower the low-temperature toughness and corrosion resistance. Accordingly, the cooling stop temperature is set to 300° C. or lower, preferably 100° C. or lower, and further preferably 30° C. or lower. On the other hand, no lower limit is placed on the cooling stop temperature, but the cooling stop temperature is preferably set to 10° C. or higher and more preferably 20° C. or higher.

(Cold Working)

Next, to provide a resulting duplex stainless steel with a desired strength, the steel raw material after the solution treatment is subjected to cold working with a rolling reduction in a thickness direction of 5% to 10%. The cold working is preferably rolling. When the rolling reduction is less than 5%, a desired high strength cannot be obtained. Further, when the rolling reduction is more than 10%, a desired toughness cannot be obtained.

(Aging Heat Treatment)

After the cold working, an aging heat treatment is performed. In the aging heat treatment, the stainless steel is heated to a heating temperature (aging treatment temperature) of 350° C. to 600° C., held at the heating temperature, and subsequently cooled. The added Cu is precipitated by the aging heat treatment, resulting in the improvement of the strength.

Heating Temperature: 350° C. to 600° C.

When the heating temperature in the aging heat treatment is higher than 600° C., a desired strength, toughness, and corrosion resistance cannot be obtained because the precipitated Cu is coarsened and additionally strain caused by the cold working is released. Accordingly, the heating temperature is set to 600° C. or lower, and preferably 500° C. or lower. On the other hand, when the heating temperature is lower than 350° C., Cu is not precipitated sufficiently, and thus, a desired high strength cannot be obtained. Accordingly, the heating temperature in the aging heat treatment is set to 350° C. or higher, and preferably 400° C. or higher.

Holding Time: 5 Minutes to 100 Minutes

When the holding time in the aging heat treatment is less than 5 minutes, the microstructure is not desirably made uniform. Accordingly, the holding time is set to 5 minutes or more, preferably 10 minutes or more, and more preferably 30 minutes or more. On the other hand, when the holding time is more than 100 minutes, a hard $\chi$ phase is precipitated, and thus a desired toughness cannot be obtained. Accordingly, the holding time is set to 100 minutes or less, and preferably 90 minutes or less.

After the holding, the stainless steel is cooled. The cooling conditions are not particularly limited, but the stainless steel is preferably cooled to room temperature. The average cooling rate in the cooling is not particularly limited, yet the average cooling rate is preferably 1° C./s or more. No upper limit is placed on the average cooling rate, but the average cooling rate may be, for example, 30° C./s or less. Any cooling method can be used in the aging heat treatment, but air cooling is preferable.

Duplex stainless steel of this disclosure can has any form. For example, the duplex stainless steel can have a sheet, or pipe or tube shape. In other words, duplex stainless steel of one embodiment may be a duplex stainless steel sheet or a duplex stainless steel pipe or tube. Specifically, the duplex stainless steel can be any one selected from the group consisting of a thin sheet, a thick plate, a seamless steel pipe or tube, a UOE steel pipe or tube, an electric-resistance-welded steel pipe or tube (ERW steel pipe or tube), a spiral steel pipe or tube, and a forged pipe or tube. Particularly, the duplex stainless steel is preferably a seamless steel pipe or tube.

For example, when a seamless steel pipe or tube made of the duplex stainless steel of this disclosure is manufactured, as the steel raw material, a steel pipe or tube having the chemical composition stated above can be used.

The steel pipe or tube (steel pipe or tube material) as the steel raw material can be manufactured by any method. For example, a billet having the chemical composition stated above may be subjected to hot working to make a steel pipe or tube. More specifically, for example, first, molten steel having the chemical composition stated above is prepared by steelmaking and subjected to continuous casting, ingot casting and blooming, or the like to obtain a billet. Next, the billet is heated and subjected to hot working, using extrusion pipe or tube making processes including the Ugine-Sejournet process, the Mannesmann pipe or tube making process, or the like to obtain a steel pipe or tube material. The steel pipe or tube material thus obtained is subjected to the solution treatment, cold working, and aging heat treatment stated above to thereby make it possible to obtain a seamless steel pipe or tube made of the duplex stainless steel of this disclosure.

EXAMPLES

A more detailed description is given below based on examples. Note that this disclosure is not limited to the following example.

First, molten steel having the chemical compositions listed in Tables 1 and 2 was prepared by steelmaking in a converter and subjected to continuous casting to obtain billets. Next, the billets were heated at 1150° C. to 1250° C., and subsequently subjected to hot working (piercing) using a model piercer to be formed into pipes or tubes to obtain steel pipe or tube materials as a steel raw material.

The steel pipe or tube materials thus obtained were subjected to solution heat treatment, cold working (rolling), and aging heat treatment under the conditions listed in Tables 3 and 4 to obtain seamless steel pipes or tubes made of duplex stainless steel.

Each of the seamless steel pipes or tubes after the aging heat treatment was subjected to quantitative determination of microstructure, a tensile test, and a Charpy impact test. The tests were carried out as follows.

(Quantitative Determination of Microstructure)

The ferrite volume fraction was measured according to the following procedure. First, a test piece was collected from the resulting seamless steel pipe or tube made of duplex stainless steel so as to observe a face perpendicular to a piercing rolling direction and at a middle position in a sheet thickness direction. Next, the test piece was etched with Vilella's reagent. Thereafter, the microstructure was imaged using an optical microscope (1000× magnification). Then, an average ferrite area ratio was calculated using an image interpretation device, and used as a volume fraction (volume %).

Furthermore, the austenite volume fraction was measured through X-ray diffraction. The measurement was performed using Kα radiation of Mo as the X-ray source under conditions of the X-ray tube voltage of 50 kV and the X-ray tube current of 84 mA. A test piece for measurement was collected from the seamless steel pipes or tubes subjected to the heat treatment (including solution heat treatment and aging heat treatment) as stated above so as to observe a middle position in the sheet thickness direction. The X-ray diffraction integrated intensities of (220) plane of the austenite phase (γ) and (211) plane of the ferrite phase (α) were measured by X-ray diffraction. Then, the austenite volume fraction was calculated using the following formula.

$$\gamma=100/(1+(I\alpha R\gamma/I\gamma R\alpha))$$

where

γ is an austenite volume fraction (%),

Iα is the integrated intensity of α,

Rα is a theoretically calculated crystallographic value of α,

Iγ is the integrated intensity of γ, and

Rγ is a theoretically calculated crystallographic value of γ.

(Tensile Test)

An API arc-shaped tensile test piece was collected from the resulting seamless steel pipe or tube made of duplex stainless steel and subjected to a tensile test in accordance with API standard to determine tensile properties (yield strength: YS, tensile strength: TS).

(Charpy Impact Test)

A V-notch test piece (having a thickness of 10 mm) was collected from the resulting seamless steel pipe or tube made of duplex stainless steel in accordance with JIS Z 2242 and subjected to a Charpy impact test to determine an absorption energy at −10° C., $vE_{-10}$.

The obtained evaluation results are as listed in Tables 3 and 4. Further, the possibility of forming a pipe or tube by hot working (piercing) in manufacturing a seamless steel pipe or tube as a steel raw material is also listed in Table 2 as "possibility of forming a pipe or tube". "Possible" indicates that it was possible to form a pipe or tube and "Impossible" indicates that it was impossible to form a pipe or tube. From a steel raw material from which a steel pipe or tube was not formed, a test piece could not be collected. Thus, such a steel raw material was not subjected to heat treatment and tests.

TABLE 1

| Steel sample | Chemical composition (in mass %)* | | | | | | | | | | | | | |
|---|---|---|---|---|---|---|---|---|---|---|---|---|---|---|
| ID | C | Si | Mn | P | S | Cr | Cu | Ni | Mo | W | V | N | Zr | B |
| A | 0.0096 | 0.52 | 0.33 | 0.012 | 0.0010 | 21.98 | 1.96 | 6.62 | 3.05 | — | 0.056 | 0.049 | — | — |
| B | 0.0103 | 0.52 | 0.34 | 0.013 | 0.0011 | 21.93 | 1.01 | 6.66 | 3.07 | — | 0.055 | 0.020 | — | — |
| C | 0.0064 | 0.54 | 0.32 | 0.011 | 0.0012 | 22.15 | 1.56 | 6.54 | 3.06 | — | 0.054 | 0.006 | — | — |
| D | 0.0110 | 0.48 | 0.32 | 0.020 | 0.0022 | 22.10 | 1.99 | 6.74 | 3.09 | — | 0.061 | 0.060 | — | — |
| E | 0.0073 | 0.47 | 0.31 | 0.019 | 0.0012 | 21.90 | 1.23 | 5.20 | 3.08 | — | 0.055 | 0.062 | — | — |
| F | 0.0070 | 0.57 | 0.29 | 0.011 | 0.0013 | 22.20 | 1.54 | 6.50 | 3.30 | — | — | 0.007 | 0.11 | 0.0027 |
| G | 0.0051 | 0.32 | 0.35 | 0.014 | 0.0011 | 21.85 | 1.31 | 6.70 | 3.00 | — | — | 0.005 | — | — |
| H | 0.0073 | 0.11 | 0.24 | 0.021 | 0.0008 | 21.41 | 1.82 | 6.21 | 2.98 | — | 0.051 | 0.006 | — | — |
| I | 0.0091 | 0.51 | 1.48 | 0.012 | 0.0011 | 21.43 | 1.74 | 6.32 | 3.12 | — | 0.048 | 0.005 | — | — |
| J | 0.0080 | 0.48 | 0.19 | 0.001 | 0.0009 | 23.00 | 1.87 | 8.35 | 3.01 | — | 0.058 | 0.056 | — | — |
| K | 0.0081 | 0.47 | 0.34 | 0.018 | 0.0012 | 23.10 | 1.94 | 7.61 | 3.06 | — | 0.055 | 0.053 | — | — |
| L | 0.0060 | 0.59 | 0.31 | 0.011 | 0.0012 | 22.00 | 1.34 | 7.00 | 3.10 | — | — | 0.007 | — | — |

TABLE 1-continued

| | | | | | | | | | | | | | | |
|---|---|---|---|---|---|---|---|---|---|---|---|---|---|---|
| M | 0.0077 | 0.51 | 0.36 | 0.012 | 0.0011 | 22.09 | 1.61 | 6.64 | 3.02 | — | 0.056 | 0.051 | — | — |
| N | 0.0054 | 0.42 | 0.28 | 0.011 | 0.0012 | 29.48 | 1.04 | 8.74 | 3.01 | — | 0.051 | 0.048 | — | — |

| Steel sample | Chemical composition (in mass %)* | | | | | | | | | | |
|---|---|---|---|---|---|---|---|---|---|---|---|
| ID | REM | Ca | Sn | Mg | Ta | Co | Sb | Al | Ti | Nb | Remarks |
| A | — | — | — | — | — | — | — | — | — | — | Conforming steel |
| B | — | — | — | — | — | — | — | — | — | — | Conforming steel |
| C | — | — | — | — | — | — | — | — | — | — | Conforming steel |
| D | — | — | — | — | — | — | — | — | — | — | Conforming steel |
| E | — | — | — | — | — | — | — | — | — | — | Conforming steel |
| F | — | — | — | — | — | — | — | — | — | — | Conforming steel |
| G | — | — | — | — | — | — | — | — | — | — | Conforming steel |
| H | — | — | — | — | — | — | — | — | — | — | Conforming steel |
| I | — | — | — | — | — | — | — | — | — | — | Conforming steel |
| J | — | — | — | — | — | — | — | — | — | — | Conforming steel |
| K | — | — | — | — | — | — | — | — | — | — | Conforming steel |
| L | 0.0023 | 0.0029 | 0.10 | 0.0008 | 0.044 | 0.042 | 0.051 | — | — | — | Conforming steel |
| M | — | — | — | — | — | — | — | — | — | — | Conforming steel |
| N | — | — | — | — | — | — | — | — | — | — | Conforming steel |

*The balance is Fe and inevitable impurities.

TABLE 2

| Steel sample | Chemical composition (in mass %)* | | | | | | | | | | | | | |
|---|---|---|---|---|---|---|---|---|---|---|---|---|---|---|
| ID | C | Si | Mn | P | S | Cr | Cu | Ni | Mo | W | V | N | Zr | B |
| O | 0.0045 | 0.49 | 0.34 | 0.008 | 0.0009 | 23.15 | 1.73 | 6.42 | 3.10 | 0.45 | — | 0.041 | — | — |
| P | 0.0072 | 0.51 | 0.32 | 0.010 | 0.0010 | 21.87 | 1.78 | 7.12 | 3.12 | — | — | 0.074 | — | — |
| Q | 0.0065 | 0.58 | 0.26 | 0.013 | 0.0013 | 22.74 | 1.02 | 8.31 | 3.04 | — | 0.059 | 0.071 | — | — |
| R | 0.0054 | 0.47 | 0.31 | 0.015 | 0.0014 | 21.35 | 1.01 | 7.51 | 3.04 | — | 0.054 | 0.072 | — | — |
| S | 0.0045 | 0.41 | 0.29 | 0.014 | 0.0008 | 21.97 | 1.03 | 8.54 | 3.01 | — | 0.053 | 0.073 | — | — |
| T | 0.0061 | 0.59 | 0.35 | 0.015 | 0.0013 | 20.54 | 1.01 | 8.45 | 3.05 | — | 0.051 | 0.074 | — | — |
| U | 0.0280 | 0.67 | 0.21 | 0.001 | 0.0009 | 20.12 | 1.07 | 7.12 | 3.89 | — | — | 0.051 | — | — |
| V | 0.0061 | 0.95 | 0.39 | 0.001 | 0.0008 | 22.01 | 1.21 | 6.51 | 2.99 | — | — | 0.054 | — | — |
| W | 0.0110 | 0.51 | 0.34 | 0.012 | 0.0007 | 21.84 | 2.01 | 6.63 | 2.97 | — | 0.054 | 0.541 | — | — |
| X | 0.0087 | 0.52 | 0.31 | 0.015 | 0.0007 | 22.00 | 1.89 | 6.50 | 3.01 | — | 0.058 | 0.106 | — | — |
| Y | 0.0110 | 0.48 | 0.31 | 0.020 | 0.0015 | 22.10 | 0.01 | 5.23 | 3.09 | — | 0.062 | 0.019 | — | — |
| Z | 0.0085 | 0.56 | 0.32 | 0.015 | 0.0009 | 22.14 | 0.05 | 3.21 | 3.01 | — | 0.054 | 0.023 | — | — |
| AA | 0.0103 | 0.54 | 0.29 | 0.012 | 0.0012 | 21.90 | 0.56 | 6.54 | 3.05 | | 0.055 | 0.060 | — | — |
| AB | 0.0107 | 0.49 | 0.35 | 0.020 | 0.0014 | 21.98 | 6.23 | 6.54 | 3.08 | — | 0.056 | 0.054 | — | — |

| Steel sample | Chemical composition (in mass %)* | | | | | | | | | | |
|---|---|---|---|---|---|---|---|---|---|---|---|
| ID | REM | Ca | Sn | Mg | Ta | Co | Sb | Al | Ti | Nb | Remarks |
| O | — | — | — | — | — | — | — | — | — | — | Conforming steel |
| P | — | — | — | — | — | — | — | 0.49 | — | — | Conforming steel |
| Q | — | — | — | — | — | — | — | — | 0.45 | — | Conforming steel |
| R | — | — | — | — | — | — | — | — | — | 0.48 | Conforming steel |
| S | — | — | — | — | — | — | — | 0.48 | — | 0.41 | Conforming steel |
| T | — | — | — | — | — | — | — | — | 0.46 | 0.47 | Conforming steel |
| U | — | — | — | — | — | — | — | — | — | — | Conforming steel |
| V | — | — | — | — | — | — | — | — | — | — | Conforming steel |
| W | — | — | — | — | — | — | — | — | — | — | Comparative steel |
| X | — | — | — | — | — | — | — | — | — | — | Comparative steel |
| Y | — | — | — | — | — | — | — | — | — | — | Comparative steel |
| Z | — | — | — | — | — | — | — | — | — | — | Comparative steel |
| AA | — | — | — | — | — | — | — | — | — | — | Comparative steel |
| AB | — | — | — | — | — | — | — | — | — | — | Comparative steel |

*The balance is Fe and inevitable impurities.

TABLE 3

| No. | Steel sample ID | Piercing: Possibility of forming pipe or tube | Solution heat treatment: Heating temperature (° C.) | Solution heat treatment: Holding time (min) | Solution heat treatment: Average cooling rate (° C./s) | Solution heat treatment: Cooling stop temperature (° C.) | Cold working: Working reduction (%) | Aging heat treatment: Heating temperature (° C.) | Aging heat treatment: Holding time (min) |
|---|---|---|---|---|---|---|---|---|---|
| 1 | A | possible | 1070 | 20 | 25 | 25 | 10 | 400 | 180 |
| 2 | A | possible | 1070 | 20 | 25 | 25 | 5 | 450 | 60 |
| 3 | A | possible | 1070 | 20 | 25 | 25 | 10 | 500 | 60 |
| 4 | A | possible | 1070 | 15 | 25 | 25 | 10 | 500 | 60 |
| 5 | A | possible | 1150 | 20 | 20 | 20 | 5 | 500 | 60 |
| 6 | A | possible | 1070 | 20 | 20 | 20 | 5 | 350 | 5 |
| 7 | A | possible | 1070 | 20 | 25 | 25 | 10 | 700 | 180 |
| 8 | B | possible | 1070 | 20 | 25 | 25 | 10 | 500 | 60 |
| 9 | B | possible | 1050 | 210 | 1 | 20 | 10 | 500 | 60 |
| 10 | B | possible | 1070 | 20 | 25 | 25 | 10 | 600 | 100 |
| 11 | B | possible | 1070 | 20 | 25 | 25 | 15 | 500 | 60 |
| 12 | B | possible | 1070 | 20 | 25 | 25 | 0 | 450 | 60 |
| 13 | C | possible | 1070 | 20 | 25 | 25 | 10 | 500 | 60 |
| 14 | C | possible | 950 | 30 | 25 | 25 | 10 | 500 | 60 |
| 15 | D | possible | 1070 | 20 | 25 | 25 | 10 | 500 | 60 |
| 16 | D | possible | 1070 | 20 | 25 | 25 | 2 | 500 | 60 |
| 17 | E | possible | 1070 | 20 | 25 | 25 | 10 | 400 | 60 |
| 18 | F | possible | 1070 | 20 | 25 | 25 | 10 | 500 | 60 |
| 19 | G | possible | 1070 | 20 | 25 | 25 | 7 | 500 | 60 |

| No. | Volume fraction: Ferrite (%) | Volume fraction: Austenite (%) | Tensile properties: Yield strength YS (MPa) | Tensile properties: Tensile strength TS (MPa) | Toughness $vE_{-10}$ (J) | Remarks |
|---|---|---|---|---|---|---|
| 1 | 54 | 46 | 981 | 1021 | 48 | Example |
| 2 | 54 | 46 | 964 | 995 | 55 | Example |
| 3 | 54 | 46 | 1002 | 1046 | 47 | Example |
| 4 | 56 | 44 | 1003 | 1047 | 45 | Example |
| 5 | 58 | 42 | 974 | 1052 | 42 | Example |
| 6 | 53 | 47 | 963 | 1049 | 43 | Example |
| 7 | 54 | 46 | 952 | 1019 | 25 | Comparative Example |
| 8 | 55 | 45 | 864 | 932 | 65 | Example |
| 9 | 53 | 47 | 862 | 928 | 62 | Example |
| 10 | 54 | 46 | 863 | 930 | 52 | Example |
| 11 | 55 | 45 | 1198 | 1299 | 18 | Comparative Example |
| 12 | 55 | 45 | 686 | 855 | 72 | Comparative Example |
| 13 | 59 | 41 | 882 | 929 | 48 | Example |
| 14 | 68 | 32 | 981 | 1041 | 31 | Comparative Example |
| 15 | 49 | 51 | 975 | 1022 | 50 | Example |
| 16 | 49 | 51 | 798 | 902 | 63 | Comparative Example |
| 17 | 48 | 52 | 863 | 948 | 45 | Example |
| 18 | 52 | 48 | 883 | 932 | 44 | Example |
| 19 | 42 | 58 | 871 | 918 | 46 | Example |

TABLE 4

| No. | Steel sample ID | Piercing: Possibility of forming pipe or tube | Solution heat treatment: Heating temperature (° C.) | Solution heat treatment: Holding time (min) | Solution heat treatment: Average cooling rate (° C./s) | Solution heat treatment: Cooling stop temperature (° C.) | Cold working: Working reduction (%) | Aging heat treatment: Heating temperature (° C.) | Aging heat treatment: Holding time (min) |
|---|---|---|---|---|---|---|---|---|---|
| 20 | H | possible | 1070 | 20 | 25 | 25 | 6 | 500 | 60 |
| 21 | I | possible | 1070 | 20 | 25 | 25 | 9 | 500 | 60 |
| 22 | J | possible | 1070 | 20 | 25 | 25 | 10 | 500 | 60 |
| 23 | K | possible | 1070 | 20 | 25 | 25 | 10 | 500 | 60 |
| 24 | L | possible | 1070 | 20 | 25 | 25 | 10 | 500 | 60 |
| 25 | M | possible | 1070 | 20 | 25 | 25 | 10 | 500 | 60 |
| 26 | N | possible | 1070 | 20 | 25 | 25 | 5 | 500 | 60 |
| 27 | O | possible | 1070 | 20 | 25 | 25 | 10 | 500 | 60 |
| 28 | P | possible | 1070 | 20 | 25 | 25 | 5 | 500 | 60 |
| 29 | Q | possible | 1070 | 20 | 25 | 25 | 5 | 500 | 60 |
| 30 | R | possible | 1070 | 20 | 25 | 25 | 5 | 500 | 60 |
| 31 | S | possible | 1070 | 20 | 25 | 25 | 5 | 500 | 60 |

TABLE 4-continued

| | | | | | | | | | |
|---|---|---|---|---|---|---|---|---|---|
| 32 | T | possible | 1070 | 20 | 25 | 25 | 5 | 500 | 60 |
| 33 | U | possible | 1100 | 40 | 25 | 25 | 6 | 500 | 60 |
| 34 | V | possible | 1050 | 30 | 30 | 25 | 7 | 400 | 60 |
| 35 | W | impossible | — | — | — | — | — | — | — |
| 36 | X | possible | 1070 | 20 | 25 | 25 | 10 | 500 | 60 |
| 37 | Y | possible | 1070 | 20 | 25 | 25 | 10 | 500 | 60 |
| 38 | Z | possible | 1070 | 20 | 25 | 25 | 25 | 500 | 60 |
| 39 | AA | possible | 1070 | 20 | 25 | 25 | 10 | 500 | 60 |
| 40 | AB | impossible | — | — | — | — | — | — | — |

| | Volume fraction | | Tensile properties | | | |
|---|---|---|---|---|---|---|
| | | | Yield | Tensile | Toughness | |
| No. | Ferrite (%) | Austenite (%) | strength YS (MPa) | strength TS (MPa) | $vE_{-10}$ (J) | Remarks |
| 20 | 51 | 49 | 868 | 935 | 41 | Example |
| 21 | 53 | 47 | 863 | 931 | 47 | Example |
| 22 | 48 | 52 | 885 | 935 | 46 | Example |
| 23 | 50 | 50 | 902 | 961 | 47 | Example |
| 24 | 58 | 42 | 889 | 932 | 50 | Example |
| 25 | 53 | 47 | 905 | 962 | 49 | Example |
| 26 | 56 | 44 | 945 | 989 | 48 | Example |
| 27 | 60 | 40 | 895 | 941 | 43 | Example |
| 28 | 54 | 46 | 912 | 975 | 41 | Example |
| 29 | 52 | 48 | 908 | 969 | 42 | Example |
| 30 | 46 | 54 | 915 | 978 | 43 | Example |
| 31 | 51 | 49 | 958 | 1003 | 41 | Example |
| 32 | 52 | 48 | 982 | 1023 | 40 | Example |
| 33 | 43 | 57 | 873 | 923 | 43 | Example |
| 34 | 45 | 55 | 912 | 957 | 40 | Example |
| 35 | — | — | — | — | — | Comparative Example |
| 36 | 28 | 72 | 821 | 897 | 68 | Comparative Example |
| 37 | 86 | 14 | 789 | 853 | 26 | Comparative Example |
| 38 | 89 | 11 | 895 | 935 | 20 | Comparative Example |
| 39 | 46 | 54 | 815 | 901 | 70 | Comparative Example |
| 40 | — | — | — | — | — | Comparative Example |

As seen from the result listed in Tables 3 and 4, the duplex stainless steel samples satisfying the conditions of this disclosure have excellent yield strength and toughness, and could be subjected to hot working during the manufacturing processes. The duplex stainless steel samples of this disclosure can be very suitably used as a material of oil country tubular goods, and the like. In contrast, the comparative stainless steel samples not satisfying the conditions of this disclosure were inferior in terms of either yield strength or toughness. Further, the comparative examples of stainless steel Nos. 35 and 40 which contain an excessive amount of Cu could not be subjected to hot working.

The invention claimed is:

1. Duplex stainless steel comprising:

a chemical composition containing, in mass %,

C: 0.03% or less,

Si: 1.0% or less,

Mn: 0.10% to 1.5%,

P: 0.030% or less,

S: 0.005% or less,

Cr: 20.0% to 30.0%,

Ni: 5.0% to 10.0%,

Mo: 2.0% to 5.0%,

Cu: 1.0% or more and less than 2.0%, and

N: less than 0.075%, with a balance being Fe and inevitable impurities, a microstructure containing:

an austenite phase in a volume fraction of 30% to 70%; and a ferrite phase in a volume fraction of 30% to 70%; and mechanical properties such that a yield strength YS is 862 MPa or more and an absorption energy in a Charpy impact test at −10° C., $vE_{-10}$, is 40 J or more.

2. The duplex stainless steel according to claim 1, wherein the chemical composition further contains, in mass %, at least one of the group consisting of a) W: 1.5% or less, b) V: 0.20% or less, c) at least one of Zr: 0.50% or less and B: 0.0030% or less, d) at least one selected from the group consisting of REM: 0.005% or less, Ca: 0.005% or less, Sn: 0.20% or less, and Mg: 0.01% or less, e) at least one selected from the group consisting of Ta: 0.1% or less, Co: 1.0% or less, and Sb: 1.0% or less, and f) at least one selected from the group consisting of Al: 0.5% or less, Ti: 0.5% or less, and Nb: 0.5% or less.

3. The duplex stainless steel according to claim 1, wherein the chemical composition contains, in mass %, Cr: 21.0% to 30.0%.

4. A seamless steel pipe or tube made of the duplex stainless steel according to claim 1.

5. A seamless steel pipe or tube made of the duplex stainless steel according to claim 2.

6. A method of manufacturing the duplex stainless steel according to claim 1, the method comprising:

subjecting a steel raw material having the chemical composition according to claim 1 to solution treatment whereby the steel raw material is heated to a heating temperature of 1000° C. or higher; then, cooled at an average cooling rate of 1° C./s or more to a cooling stop temperature of 300° C. or lower, subjecting the steel raw material after the solution treatment to cold working with a rolling reduction in a thickness direction of 5% to 10%, and subjecting the steel raw material after the cold working to aging heat treatment whereby the steel raw material is heated to a heating temperature of 350° C. to 600° C., held at the heating temperature for a holding time of 5 minutes or more and 100 minutes or less, and subsequently cooled.

7. A method of manufacturing the duplex stainless steel according to claim 2, the method comprising:

subjecting a steel raw material having the chemical composition according to claim 2 to solution treatment whereby the steel raw material is heated to a heating temperature of 1000° C. or higher; then, cooled at an average cooling rate of 1° C./s or more to a cooling stop temperature of 300° C. or lower, subjecting the steel raw material after the solution treatment to cold working with a rolling reduction in a thickness direction of 5% to 10%, and subjecting the steel raw material after the cold working to aging heat treatment whereby the steel raw material is heated to a heating temperature of 350° C. to 600° C., held at the heating temperature for a holding time of 5 minutes or more and 100 minutes or less, and subsequently cooled.

* * * * *